US006820863B2

(12) United States Patent
Rosati

(10) Patent No.: US 6,820,863 B2
(45) Date of Patent: Nov. 23, 2004

(54) PORTABLE MOTORIZED CHAIN DRIVER

(76) Inventor: James Rosati, 148 Sandra La., No. Andover, MA (US) 01845

( * ) Notice: Subject to any disclaimer, the term of this patent is extended or adjusted under 35 U.S.C. 154(b) by 0 days.

(21) Appl. No.: 10/421,087

(22) Filed: Apr. 23, 2003

(65) Prior Publication Data

US 2004/0211951 A1 Oct. 28, 2004

(51) Int. Cl.[7] ..... B66D 1/20

(52) U.S. Cl. ..... 254/358; 254/371; 254/372; 254/382

(58) Field of Search ..... 254/358, 371, 254/372, 382, 465, 362

(56) References Cited

U.S. PATENT DOCUMENTS

| | | | | |
|---|---|---|---|---|
| 514,251 A | | 2/1894 | Zastrow | |
| 655,367 A | | 8/1900 | Morgan et al. | |
| 836,789 A | | 11/1906 | Vance | |
| 1,152,608 A | * | 9/1915 | Cull | 474/140 |
| 1,245,492 A | * | 11/1917 | Moore | 474/140 |
| 1,464,259 A | | 8/1923 | Coffing | |
| 1,753,084 A | * | 4/1930 | Kappel | 254/405 |
| 1,891,883 A | | 12/1932 | Stahl | |
| 2,044,565 A | | 6/1936 | Coffing | |
| 2,286,388 A | * | 6/1942 | Smith | 254/372 |
| 2,342,091 A | | 2/1944 | Schroeder | |
| 2,649,280 A | | 8/1953 | Rausenberger et al. | |
| 2,991,976 A | | 6/1961 | Carroll | |
| 3,030,076 A | * | 4/1962 | Stevens | 254/358 |
| 3,197,162 A | | 7/1965 | Johanson et al. | |
| 4,162,059 A | | 7/1979 | Fletchall | |
| 4,348,011 A | * | 9/1982 | Honda | 254/350 |
| 4,434,974 A | * | 3/1984 | LaCount | 254/360 |
| 4,552,340 A | | 11/1985 | Sheppard | |
| 4,576,363 A | * | 3/1986 | Pancook | 254/372 |
| 4,646,805 A | | 3/1987 | Dohmeier | |
| 4,669,619 A | | 6/1987 | Kimblad | |
| 6,554,255 B2 | * | 4/2003 | Fujikawa | 254/358 |

* cited by examiner

*Primary Examiner*—Kathy Matecki
*Assistant Examiner*—Evan Langdon
(74) *Attorney, Agent, or Firm*—Pearson & Pearson, LLP

(57) ABSTRACT

A portable, motorized chain driver for lifting and lowering loads by attaching the chain driver to a manual chain hoist for driving the chain. The chain driver comprises a chain and rotor housing attached to a compact electrical or gas driver unit with an angled head, a gear reduction and a handle with direction and speed controls. The chain and rotor housing comprises two halves which include integral chain guides, a central rotor and clutch area and a drive source mount. The chain driver is particularly useful for driving manual chain driven hoists and garage doors.

28 Claims, 12 Drawing Sheets

PORTABLE MOTORIZED CHAIN DRIVER

BACKGROUND OF THE INVENTION

1. Field of the Invention

This invention relates to chain drivers for lifting and lowering loads of a manual chain hoist, and in particular to a portable, motorized, chain driver easily carried by a chain hoist operator.

2. Description of Related Art

There are many chain hoist mechanisms in the prior art which are used in industry particularly on mechanical handling of materials in shops and warehouse employing hoists, and which may be geared and electrically driven, hydraulically driven, or manually driven via an endless chain. Typically, hoists extend from overhead monorail systems and can be either manual or power driven. They also are portable, and it is desirable that they not be too heavy so that they can be easily moved from one location to another.

For example, U.S. Pat. No. 2,991,976 issued Jul. 11, 1961 to Charles Carroll and assigned to Duff-Norton Company of Pittsburg, Pa. discloses a power driven hoist driven by an electric motor which powers a chain and is normally coupled to an overhead monorail trolley.

Other prior art patents include U.S. Pat. No. 836,789 issued Nov. 27, 1906 to Walter N. Vance and assigned to Yale & Towne Manufacturing company of Stamford, Conn. discloses a portable electric hoist comprising a chain-block, an electric motor and an electric controller located on the opposite side of the chain block and they all rest in the same horizontal plane. However, this hoist is not held by an operator when hoisting a load.

U.S. Pat. No. 4,646,805 issued Mar. 3, 1987 to Hans-Otto Dohmeier of Johannesburg, South Africa discloses a chain winch having a sprocket wheel of polygonal cross-section with flat faces dimensioned in dependence on the dimensions of a link chain to be used therewith and having pin formations for engaging between or in the chain links. However, it does not disclose a hand held portable chain driver.

None of the above patents disclose the structural features of the present invention, which is intended to be portable and drive a manual chain hoist.

SUMMARY OF THE INVENTION

Accordingly, it is therefore an object of this invention to provide a portable hand held tool that attaches to a manual chain hoist to drive hand chains, lifting and lowering the hoist's load.

It is another object of this invention to provide a portable, motorized, chain driver that attaches to and hangs from each side of circulator hoist hand chains at any desired location along the chains.

It is another object of this invention to provide a portable motorized chain driver that operates manual chain driver garage doors.

It is a further object of this invention to provide means for switching the direction of the chain or chains being driven by the chain driver and to provide variable speed control.

It is another object of this invention to provide a rotor assembly comprising a pocket wheel, a sprocket wheel, and a clutch disc for moving the chain through the chain driver.

These and other objects are accomplished by a portable chain driver comprising a chain and rotor housing for receiving links of a chain, and a power source attached to the chain and rotor housing for driving the chain through the housing. The chain and rotor housing comprises means for securing a chain pail under the housing. The chain and rotor housing comprises a front housing and a rear housing, the front housing and the rear housing comprise means for securing the front housing and the rear housing together. The securing means comprises a first hinge pin on a first side of the housing and a second hinge pin on a second side of the housing wherein removal of one hinge pin allows the front housing to swing open for installing or removing the chain. The chain and rotor housing comprises a front housing and a rear housing secured together, chain guides on each side of the front housing and the rear housing, a rotor assembly positioned within the housing and extending through the rear housing, and means attached to the rotor assembly and extending through the front housing for controlling the operation of the rotor assembly. The chain and rotor housing comprises a rotor assembly including a chain pocket wheel and a chain sprocket wheel attached within the chain pocket wheel. The power source comprises means for driving the chain in the housing with an electrical power source. The power source may also comprise means for driving the chain in the housing with a gas driven power source. The power source comprises a handle. The handle comprises means for selecting the direction and speed of the chain passing through the housing. Also, the handle location and position optimizes means of reacting to the rotor torque and hoist loads. The chain and rotor housing comprises a rotor assembly enclosed within a front housing and a rear housing of the chain and rotor housing, and means for interfacing the rotor assembly to the power source. The rotor assembly comprises a rotor, a rotor centering hub positioned through the front housing and into a center portion of the rotor, a bushing positioned around the rotor centering hub, a clutch disc having a first end positioned adjacent to the rotor, a drive shaft inserted into the clutch disc and attached within the rotor centering hub, and a spring pack positioned adjacent to a second end of the clutch disc, the drive shaft passing through the spring pack. The rotor centering hub further comprises a clutch cam lever located within an end of the rotor centering hub for engaging and disengaging the clutch disc. The rotor centering hub comprises a lock screw for attaching the rotor centering hub to the drive shaft. The drive shaft comprises a hex portion for insertion into a hex receiving section of the clutch disc.

The objects are further accomplished by a method of providing a portable chain driver comprising the steps of positioning links of a chain in a chain and rotor housing, and attaching a power source to the chain and rotor housing for driving the chain through the housing. The step of positioning links of a chain in the chain and rotor housing comprises the steps of providing the chain and rotor housing with a front housing section and a rear housing section, and opening the front housing section to install or remove the links of the chain. The method comprises the steps of providing the chain and rotor housing with a chain sprocket wheel attached within a chain pocket wheel, and providing a rotor assembly having a shaft passing into the chain and rotor housing. The step of providing the chain and rotor housing with a chain sprocket wheel attached within a chain pocket wheel comprises the step of providing the sprocket wheel in sections which are secured to the pocket wheel. The step of attaching a power source comprises the step of attaching an electrically driven power source. The step of attaching a power source also comprises the step of attaching a gas driven power source. The method comprises the step of attaching a pail under the chain and rotor housing for collecting the chain passing through the chain driver.

Additional objects, features and advantages of the invention will become apparent to those skilled in the art upon consideration of the following detailed description of the preferred embodiments exemplifying the best made of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
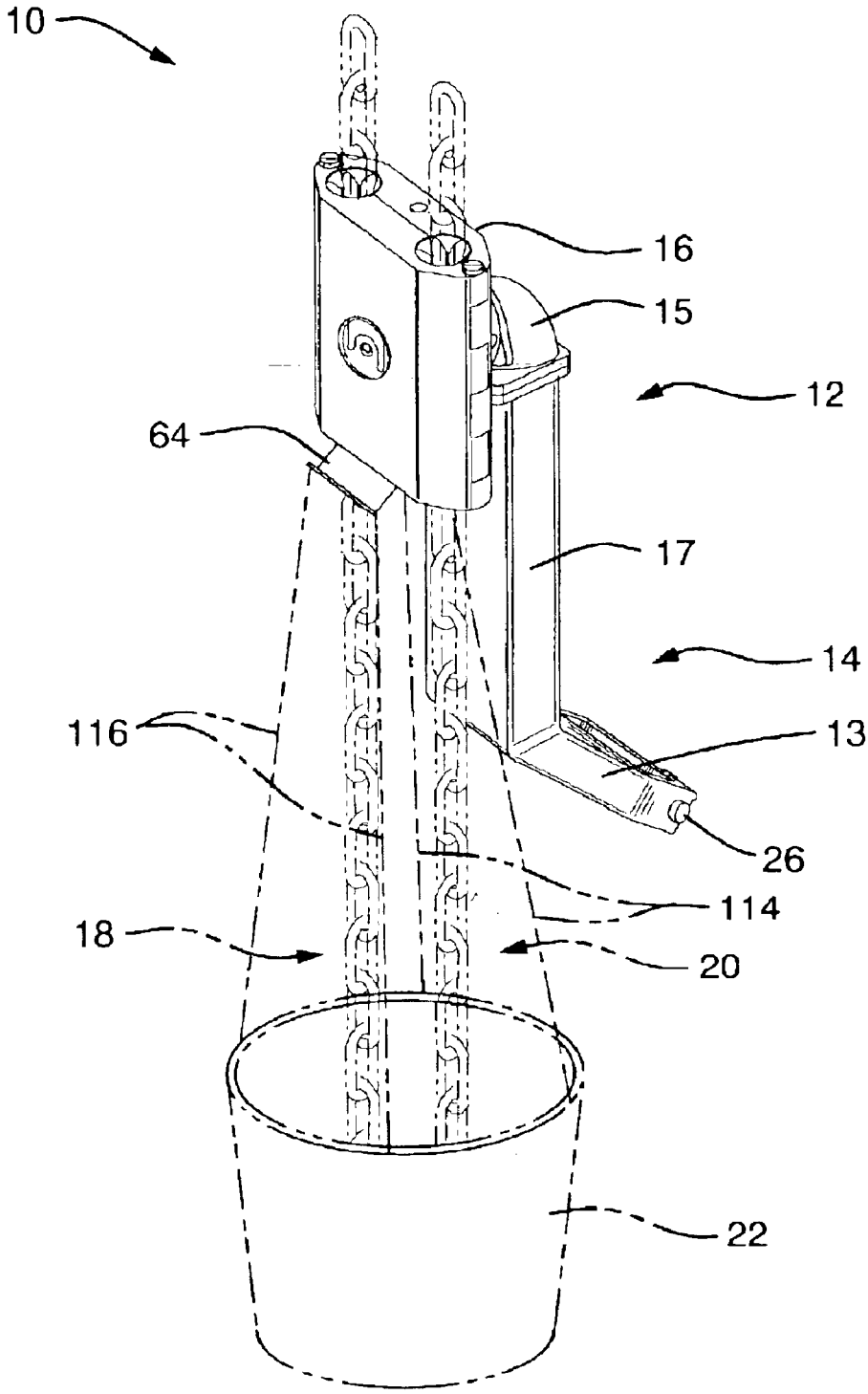
FIG. 1 is an isometric view of a portable motorized chain driver assembly according to the invention showing a chain passing to and from a collection pail.

Referring to FIG. 1, a portable motorized, chain driver assembly 10 according to the invention is shown comprising a chain driver 12, chains 18, 20 passing through two sides of a housing 16 of the chain driver 12 and a pail 22 for collecting and allotting the chains 18, 20. The chain driver 12 attaches to a manually operated chain hoist comprising chains 18, 20 and automates the lifting and lowering of a chain hoist's loads. Also, the chain driver 12 may be attached to and hangs from each side of a circulator hoist hand chain at any desired location along the length of the chain. In this configuration the chain driver 12 confines the chain and guides it to a central rotor driving the chains in either direction.

Figure 2:
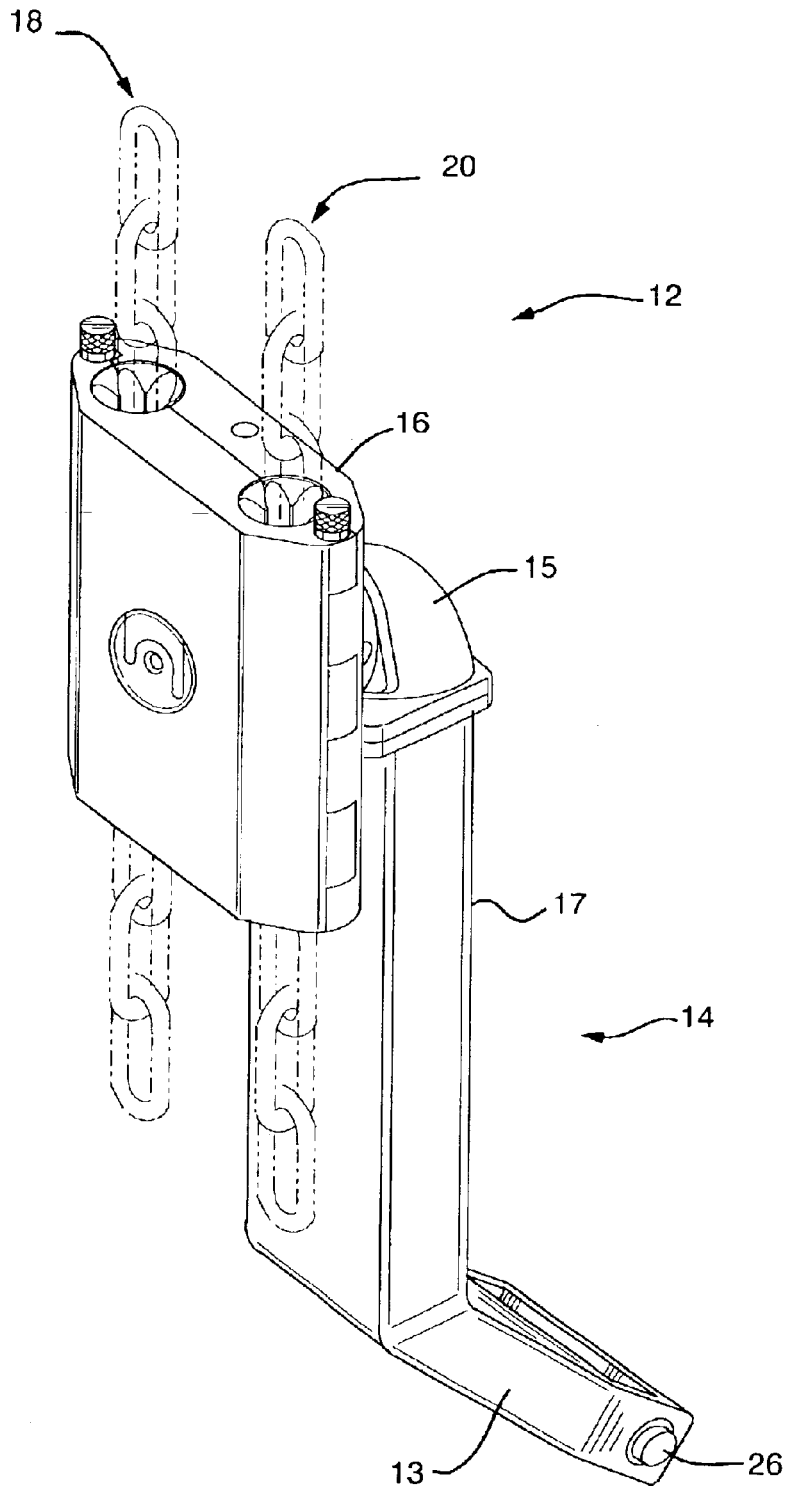
FIG. 2 is an isometric view of the invention showing a power handle assembly with an electrical power source and a chain and rotor housing with a chain passing through the housing.
Figure 4:
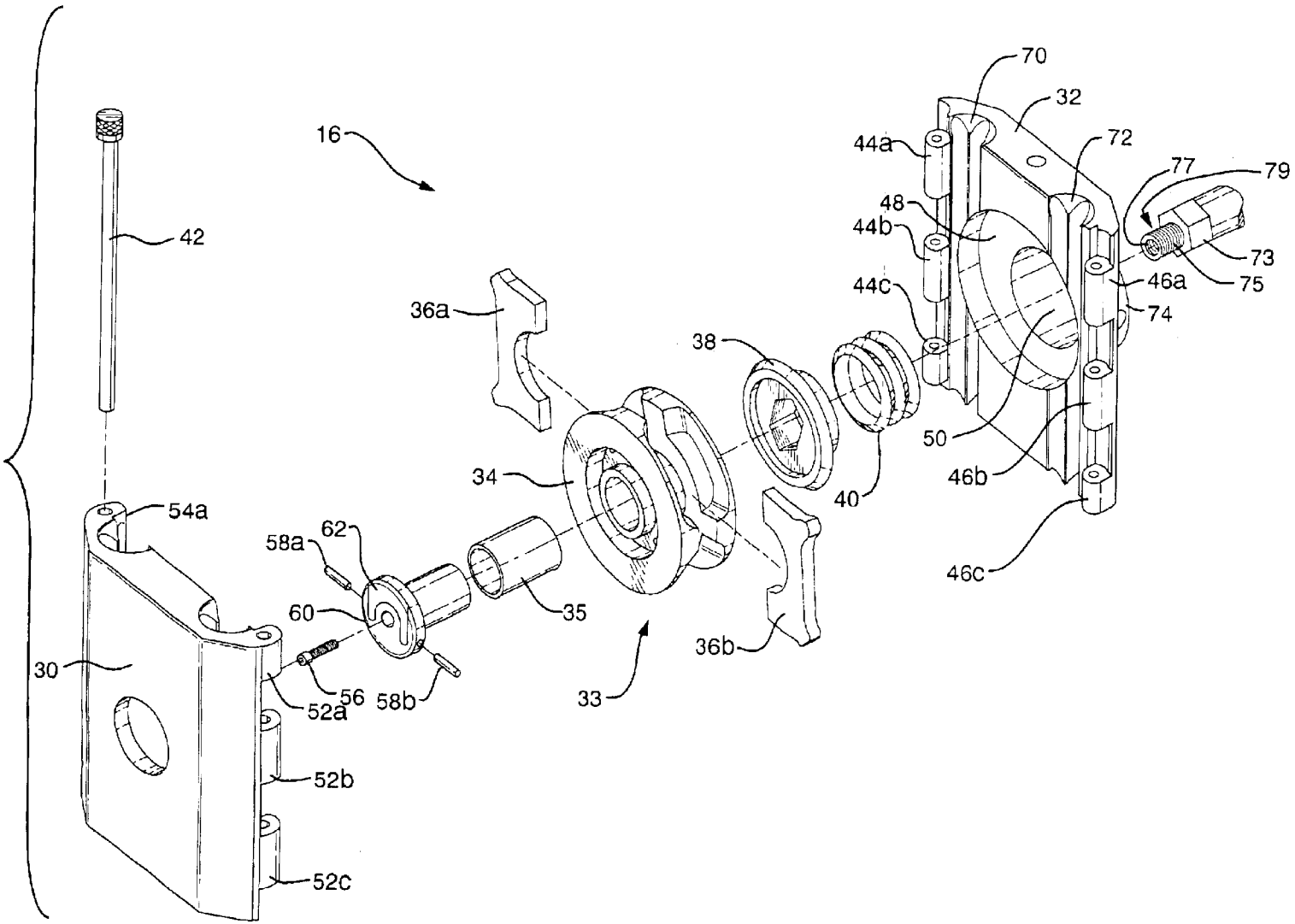
FIG. 4 is an exploded perspective view of the chain and rotor housing according to the invention.

Referring to FIG. 2 and FIG. 4, FIG. 2 is an isometric view of the chain driver 12, and FIG. 4 is an exploded perspective view of a chain and rotor housing 16 of the chain driver 12. The chain driver 12 comprises the chain and rotor housing 16 attached to an angled geared head 15 of a power handle assembly 14. The other end of angled geared head 15 attaches to a drive source 17 comprising a compact electrical power source and reduction gears or a gas driven power source with reduction gears. A handle 13 is attached to the lower portion of the power handle assembly 14 and includes a variable speed electrical plunger switch 26 mounted on the side of the handle 13. The handle 13 provides horizontal control by mating to the power source 17 to provide the means of gripping horizontally. The electric power source 17 may be embodied by ½" Magnum Drill with 90 degree drive attachment, Cat #02341, producing approximately 30 Lb.-Ft. torque at up to 825 RPM variable speed, manufactured by Milwaukee Electric Tool Corporation, of Brookfield, Wis. Other electrical driven power sources may be used that provide similar drive capability.

Figure 3:
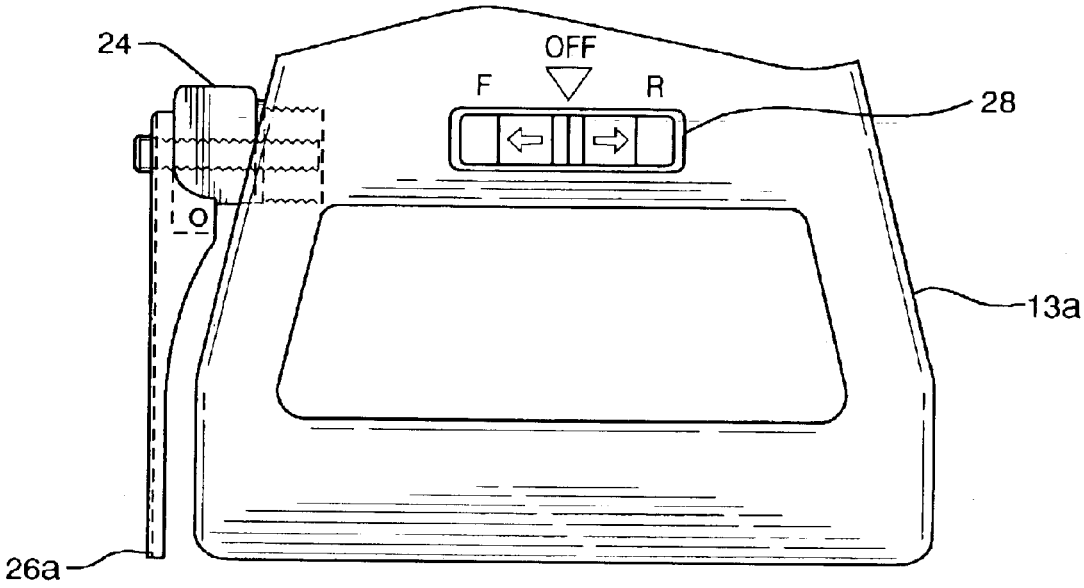
FIG. 3 is a front elevational view of an alternate handle for the power handle assembly of the invention having a gas variable speed control.

Referring to FIG. 3, a front elevational view of an alternate handle 13*a* for the power handle assembly 14 is shown for use with a gas driven power source. The handle 13 and the handle 13*a* both include a forward/reverse switch 28 for controlling the direction of the chain 18, 20 through the chain driver 12. An air swivel connector 23 with quick disconnect fittings may be attached to valve 24 in the handle 13*a* for driving the chain driver 12 with a gas. Further, a variable speed lever 26*a* is provided on the side of handle 13. A gas or air driven power source 17*a* (FIG. 18) may be embodied by Model CP-825 ¼, with 30 lb.-Ft. of torque variable speed manufactured by Chicago Pneumatic Tool Company of Rock Hill, S.C. The angled geared head 15 is similarly configured as for the electric power source.

Figure 5:
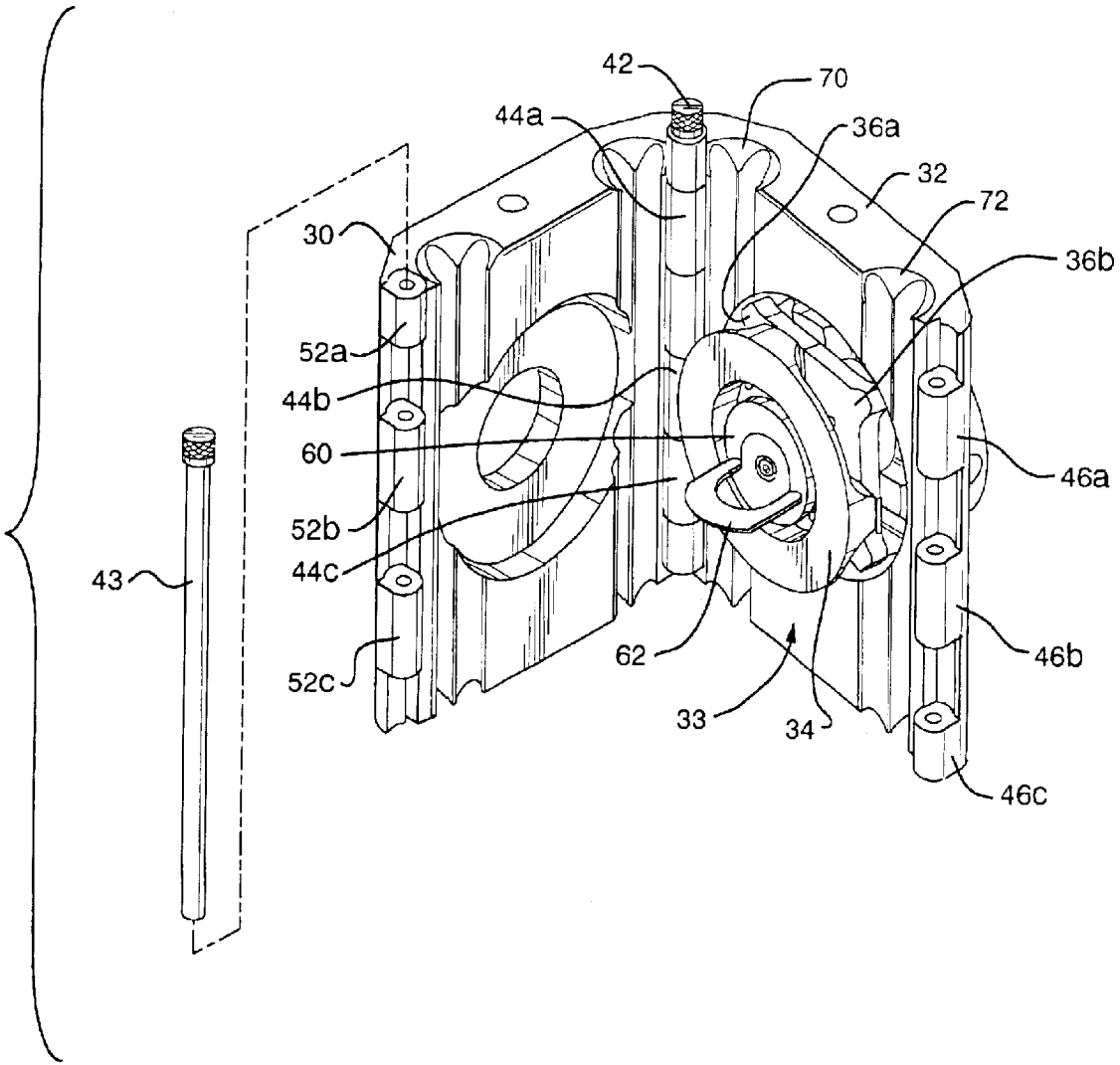
FIG. 5 is a perspective view of the chain and rotor housing in a half open position.

Referring to FIG. 4 and FIG. 5, FIG. 5 is a perspective view of the chain and rotor housing 16 in a half open position showing a front housing 30 and a rear housing 32 which rotate about a hinge pin 42. Two hinge pins 42, 43 are used to attach the front housing 30 to the rear housing 32. Each of the hinge pins 42, 43 comprises an accentric locking bushing at the top to provide easy access and locking of the pins 42, 43 in the chain and rotor housing 16. Each side of the front housing 30 comprises integral hinges 52*a*, 52*b*, 53*c*, 54*a*, 54*b*, 54*c* for receiving the hinge pins 42, 43 and likewise, each side of the rear housing 32 comprises integral spaced-apart hinges, 44*a*, 44*b*, 44*c*, 46*a*, 46*b*, 46*c* for receiving the hinge pins 42, 43. As shown in FIG. 5, the front housing 30 has rotated around hinges 44*a*, 44*b*, 44*c*, and hinges 54*a*, 54*b*, 54*c* on the rear housing 32, leaving the chain and rotor housing 16 in a partially open position. When the front housing 30 is mated with rear housing 32, the hinges on the front housing 30 fill the spaces between the hinges on the rear housing 32 holding alignment and locking of the housing halfs together.

Referring to FIG. 4, the chain and rotor housing 16 comprises integral chain guides 70, 72, a central rotor assembly 33 with a clutch disc 38, a drive source mount 74, and a bracket 64 (FIG. 1) attached to a bottom portion of said chain and rotor housing 16 for securing a chain pail 22. The chain and rotor housing 16 further comprises a rotor centering hub 60, which is assembled onto the center of the front end drive shaft 79, and it is held onto the drive shaft 79 with a hub lock screw 56. A cam lever 62 is positioned in a head portion of the rotor centering hub 60, and it rotates about two lever pins 58*a*, 58*b*. With the rotor centering hub 60 in position, a self lubricated bushing 35 is inserted around the cylindrical body of the rotor centering hub 60 and an end of the bushing 35 abuts the cam lever 62.

Figure 9:
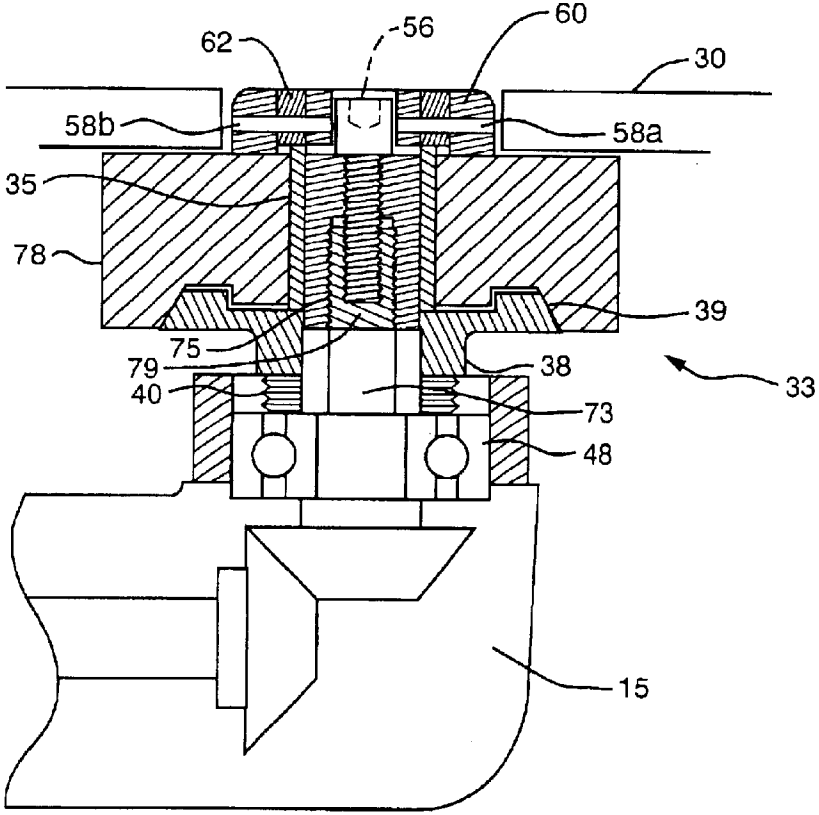
FIG. 9 is a side cross-sectional view of a rotor assembly with a clutch disc positioned around a drive shaft with a clutch cam lever engaged.

Referring to FIG. 4 and FIG. 9, FIG. 9 is a side cross-sectional view of the rotor assembly 33 with a clutch disc 38 positioned around a hex section 73 of drive shaft 79 and showing the clutch disc 38 engaged with the rotor 78. FIG. 9 also shows the angled gear head 15 interfacing with the rotor assembly 33. A Bellville spring pack 40 is positioned around a lower portion of the hex section 73 of the drive shaft 79 and between the clutch disc 38 and the inner rail of the drive shaft bearings 48 for mounting the clutch disk 38 within the clutch contact area 39 and for enabling the clutch disc 38 to be moved away from the clutch contact area 39, when the clutch cam lever 62 is lifted up.

Figure 10:
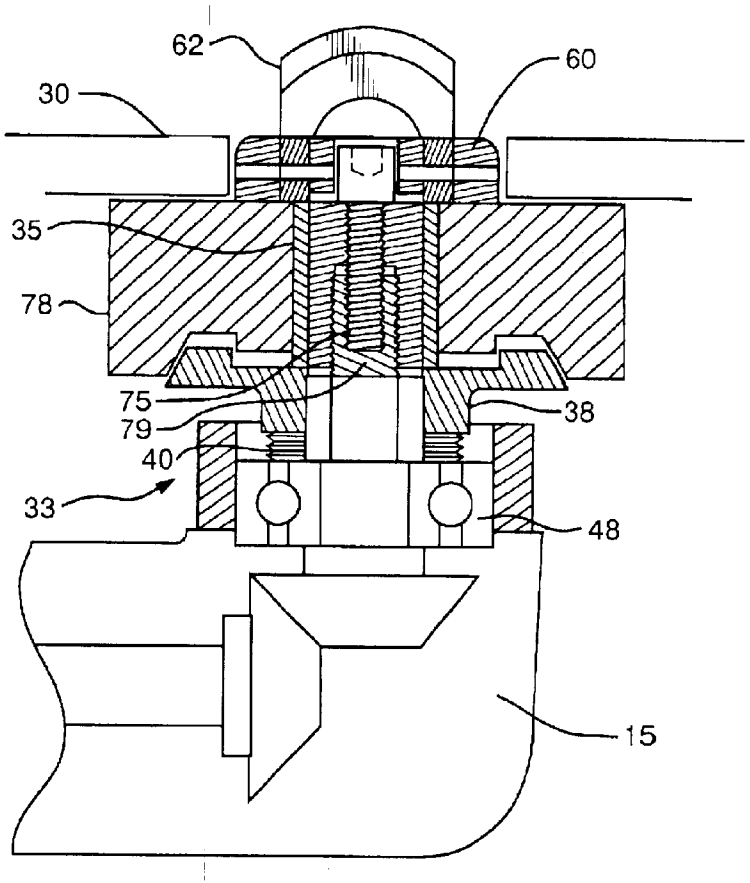
FIG. 10 is a side cross-sectional view of the rotor assembly with the clutch disc disengaged from the rotor assembly by lifting up the clutch cam lever.

Referring now to FIG. 10, FIG. 10 is a side cross-sectional view of the rotor assembly 33 with the clutch disc 38 disengaged from the rotor assembly 33 by lifting-up the clutch cam lever 62. The clutch cam lever 62 presses on the bushing 35 which pushes the clutch disc 38 away from the clutch contact area 39 of the rotor 78.

Figure 6:
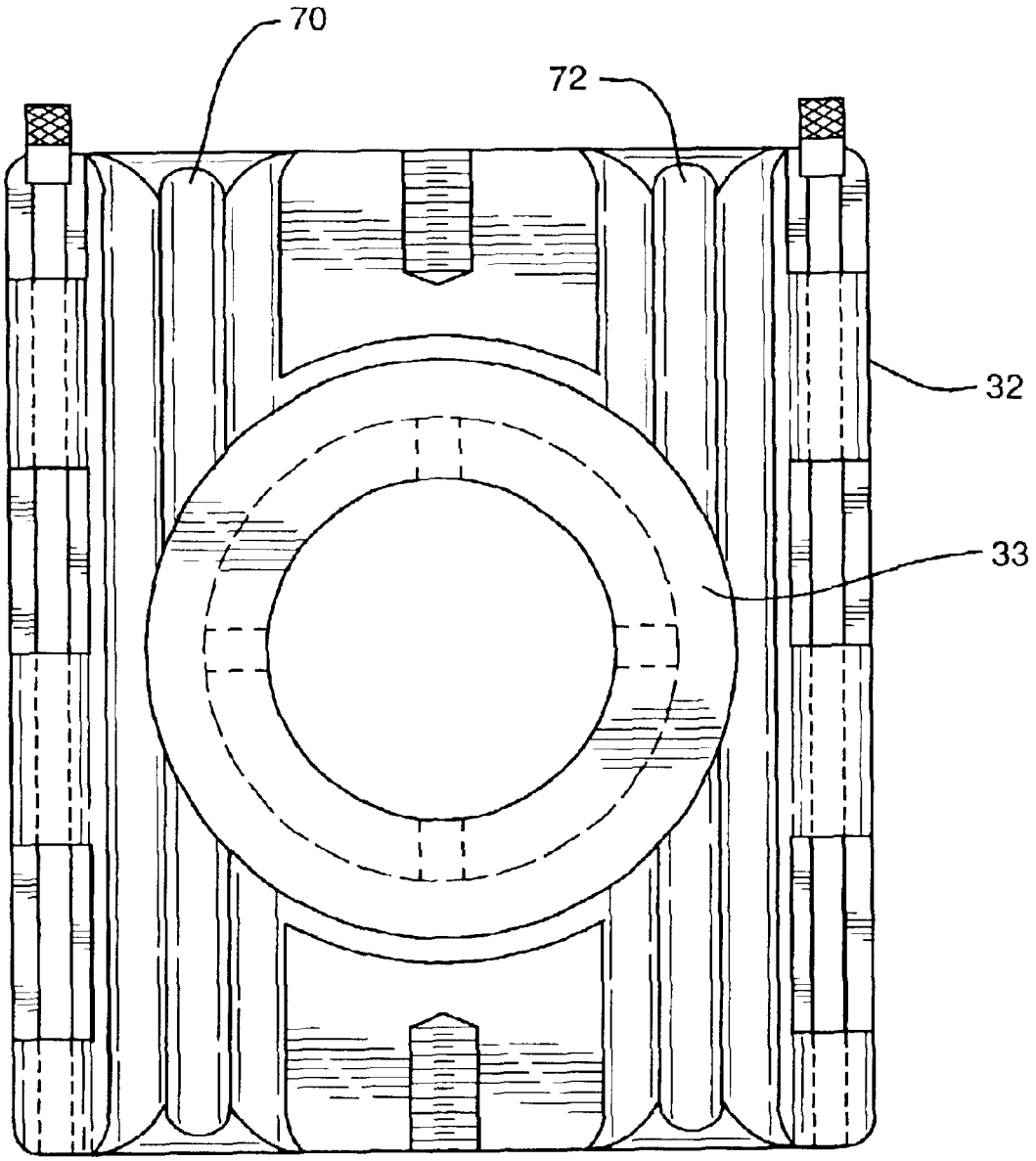
FIG. 6 is an elevational view of a rear housing portion of the chain and rotor housing showing chain guide channels.
Figure 7:
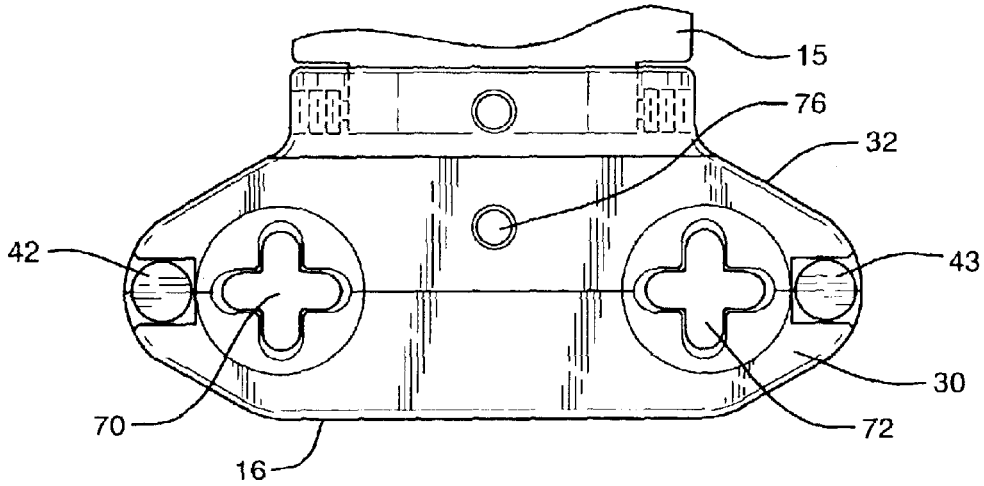
FIG. 7 is a top plan view of the chain and rotor housing showing chain guide openings and hinge pins.
Figure 18:
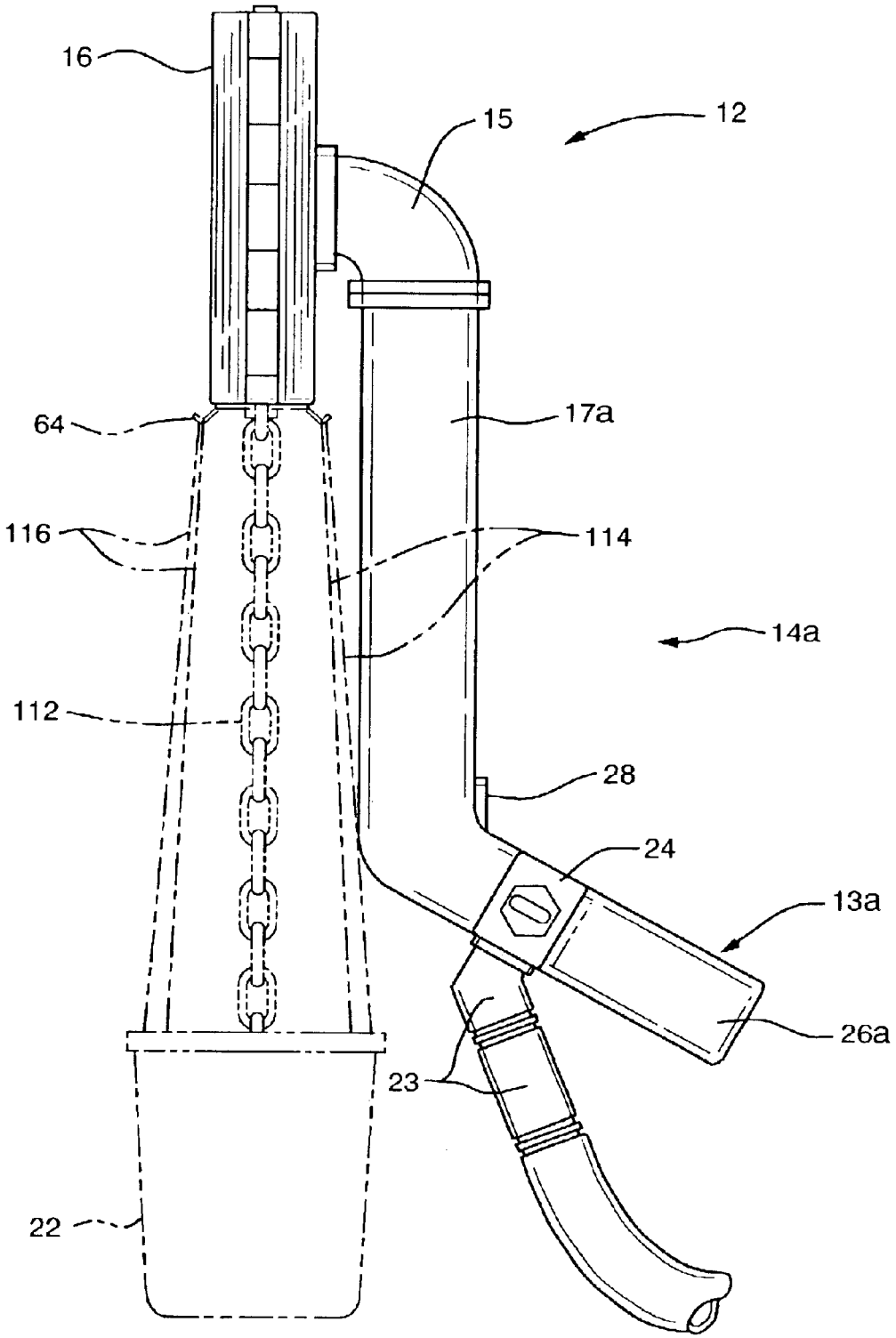
FIG. 18 is a side elevational view of the chain driver having a chain pail hanging from a four point cable sling attached to a bracket and showing a gas hose connection on a side of the handle.

Referring to FIG. 6 and FIG. 7, FIG. 6 is an elevational view of the rear housing 32 portion of the chain and rotor housing 16 showing the chain guides 70, 72 and the rotor assembly 33 release and engagement mechanism. FIG. 7 is a top plan view of the chain and rotor housing 16 showing chain guide openings 70, 72 for guiding chains 18, 20 passing through the housing 16. The hinge pins 42, 43 secure the front housing 30 to the rear housing 32. A tapped hole 76 on the top of housing 16 provides for insertion of an eye hook for hanging the chain driver 12. The tapped holes on the bottom of housing 16 provide for hanging a bracket 64 to a pail 22 as shown in FIG. 18.

Figure 8:
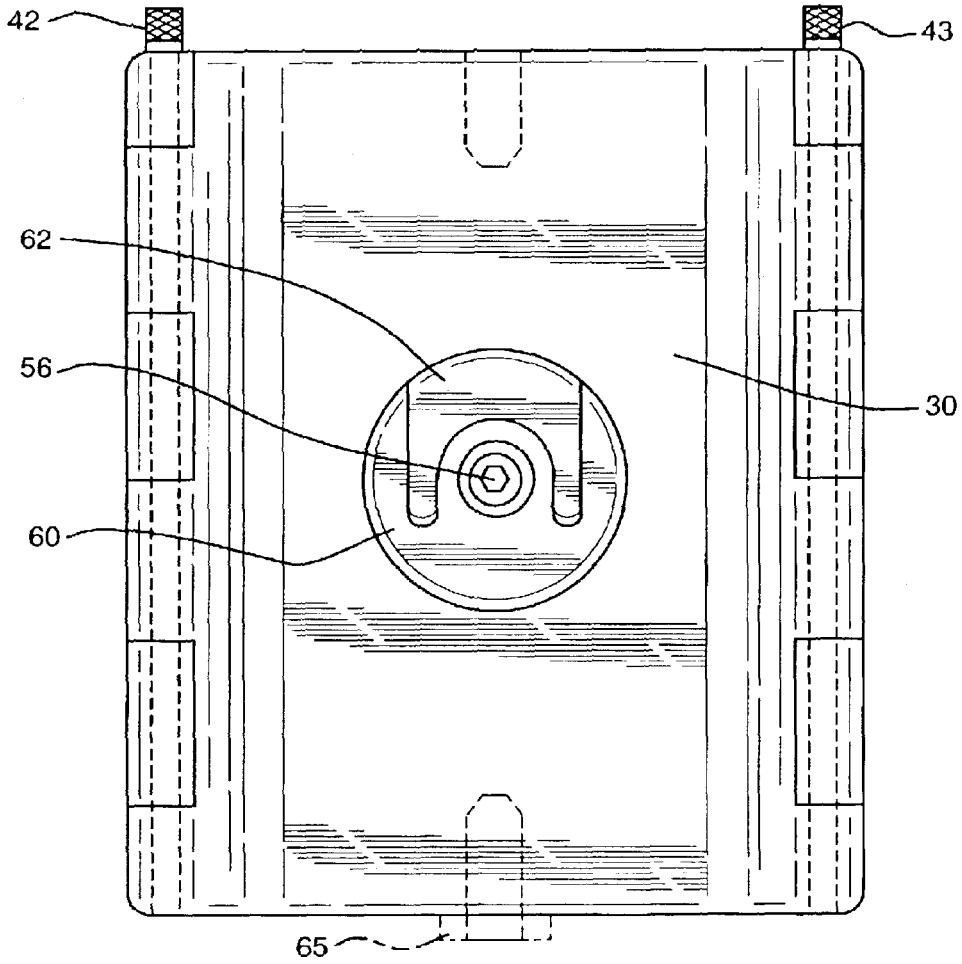
FIG. 8 is a front elevational view of the assembled housing showing a clutch cam lever and a rotor centering hub.

Referring to FIG. 8, a front elevational view is shown of the rear housing 30 of an assembled housing 16 comprising the rotor centering hub 60, secured by hub lock screw 56. The clutch cam lever 62 is recessed within the rotor centering hub 60 and lifts outward when the clutch disc 38 is disengaged.

Figure 17:
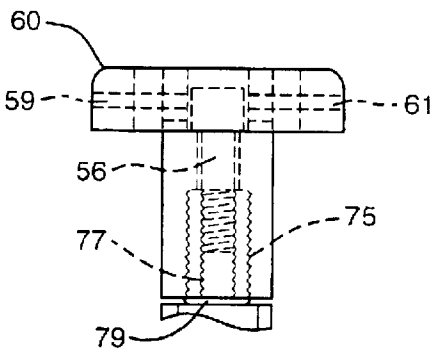
FIG. 17 is a side elevational view of the rotor centering hub without the clutch cam lever.
Figure 16:
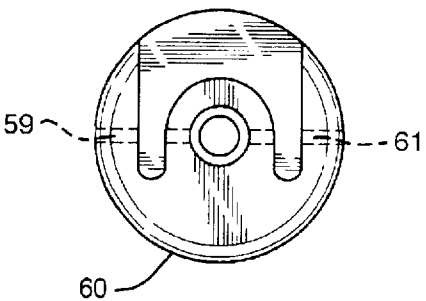
FIG. 16 is a top plan view of the rotor centering hub without the clutch cam lever.
Figure 15:
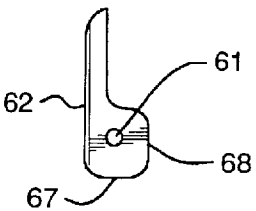
FIG. 15 is a side elevational view of the clutch cam lever.
Figure 14:
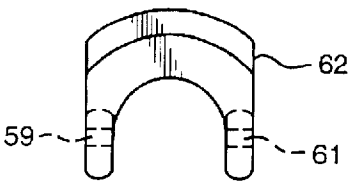
FIG. 14 is a top plan view of a clutch cam lever.

Referring to FIG. 14 through FIG. 17, FIG. 14 is a top plan view of the clutch cam lever 62 showing holes 59, 61 for receiving lever pins 58*a*, 58*b* (FIG. 4). FIG. 15 is a side elevational view of the clutch cam lever 62 having flat surfaces 67, 68 for positive contact when the clutch disc 38 is in the engaged and disengaged positions. FIG. 16 is a top plan view of the rotor centering hub 60 without the clutch cam lever 62 and showing the area cut-out for receiving the clutch cam lever 62. FIG. 17 is a side elevational view of the rotor centering hub 60 without the clutch cam lever installed. The inner threads 77 in the vertical portion receive the drive shaft mounting and adjusting stud 79. Once adjusted, the hub locking screw 56 locks the adjusting hub stud 79 in that position.

Referring again to FIG. 4, the rotor assembly 33 comprises a chain pocket wheel 34 and a chain sprocket wheel 36*a*, 36*b* which guide the chains 18, 20 (FIG. 1) through the housing 16. The chains 18, 20 when installed into the chain and rotor housing 16 can be guided either straight through, or around an end of a circular hand hoist chain, wrapping around 180 degrees of the sprocket wheel 36. The sprocket wheel 36 comprises two sprocket sections 36*a* and 36*b*, and they are inserted into the pocket wheel 34 and secured with four pins 92*a*, 92*b*, 92*c*, 92*d* (FIG. 11).

Figure 13:
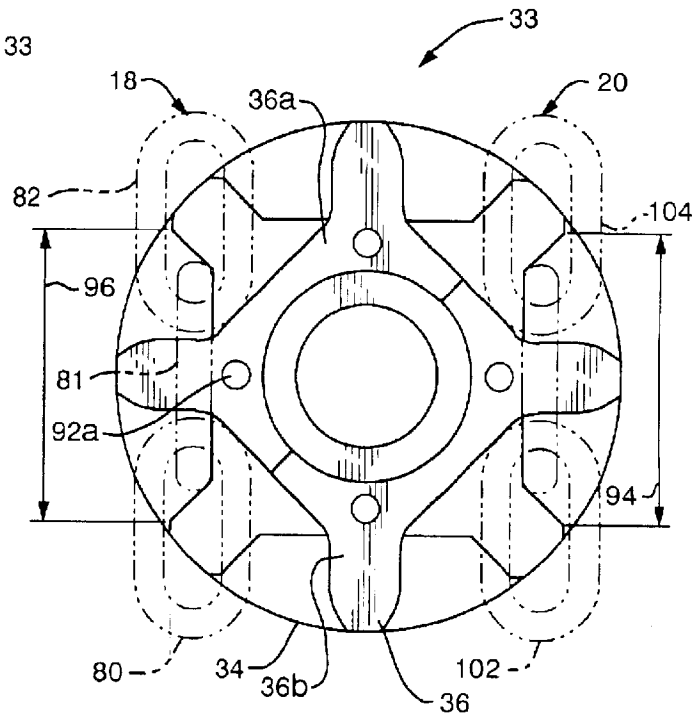
FIG. 13 is a front elevational view of the pocket wheel and sprocket wheel showing chains being guided through each side of the chain and rotor housing.
Figure 12:
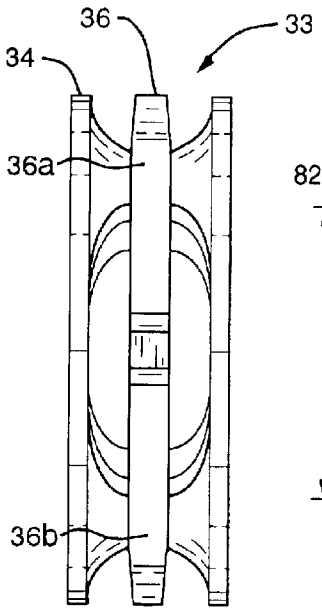
FIG. 12 is an end elevational view of the pocket wheel with a sprocket wheel inserted therein.
Figure 11:
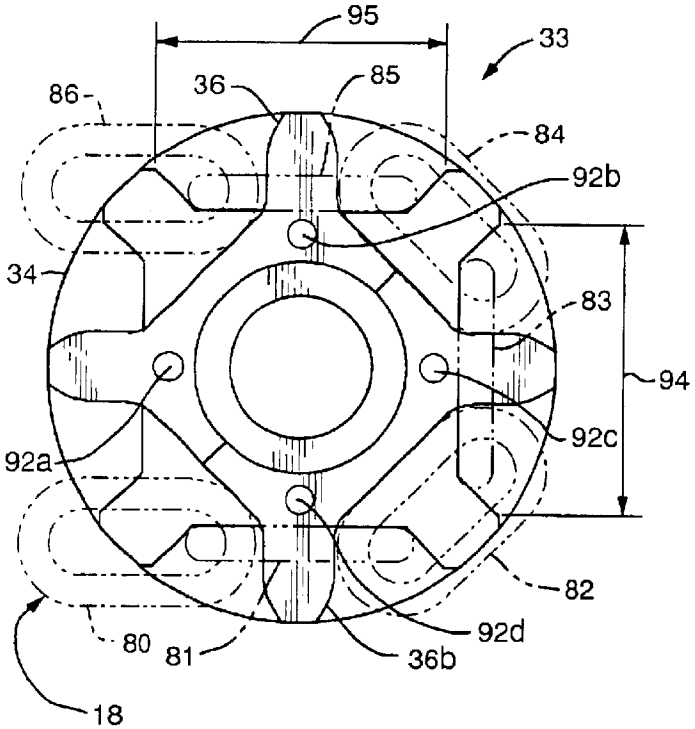
FIG. 11 is a front elevational view of the pocket wheel showing chain links positioned in a pocket area and the sprocket wheel inserted into chain links of a chain that goes around the sprocket wheel.

Referring to FIG. 11, FIG. 12 and FIG. 13, FIG. 11 shows a front elevational view of the pocket wheel 34 with chain links 80–86 positioned in pocket areas such as pocket areas 94, 95 where chain link 83 is located, and shows sprocket wheel 36 inserted into chain links 81, 83, 85 of the chain 18. FIG. 12 is an end elevational view of the rotor assembly 33 comprising the pocket wheel 34 and the sprocket wheel 36. The sprocket wheel 36 comprises two sections 36*a*, 36*b* for ease of assembly. FIG. 13 is a front elevational view of the pocket wheel 34 and the sprocket wheel 36 showing chains 18, 20 being guided through each side of the chain and rotor housing 16. Chain links 80, 81 and 82 of chain 18 are shown on the left side of the pocket wheel 34 and sprocket wheel 36, and chain links 102, 103 and 104 of chain 20 are shown on the right side of rotor assembly 33.

Referring now to FIG. 18 a side elevational view of the chain driver 12 is shown having a chain pail 22 hanging from bracket 64 attached to the bottom of housing 16. Cables 114, 116 attaches to the mounting bracket 64, and the chain pail 22 hangs from the cables 114, 116. Suspending the chain pail 22 under the chain driver housing 16 provides for collecting excess chain 112 and preventing entanglement with other equipment in an area of use. FIG. 18 shows the embodiment of the chain driver 12 comprising a gas driven power source 17*a* and the handle 13*a* (FIG. 3) having a gas swivel connector 23 connected to valve 24 on the handle 13*a* with the variable speed lever 26*a*.

Figure 19:
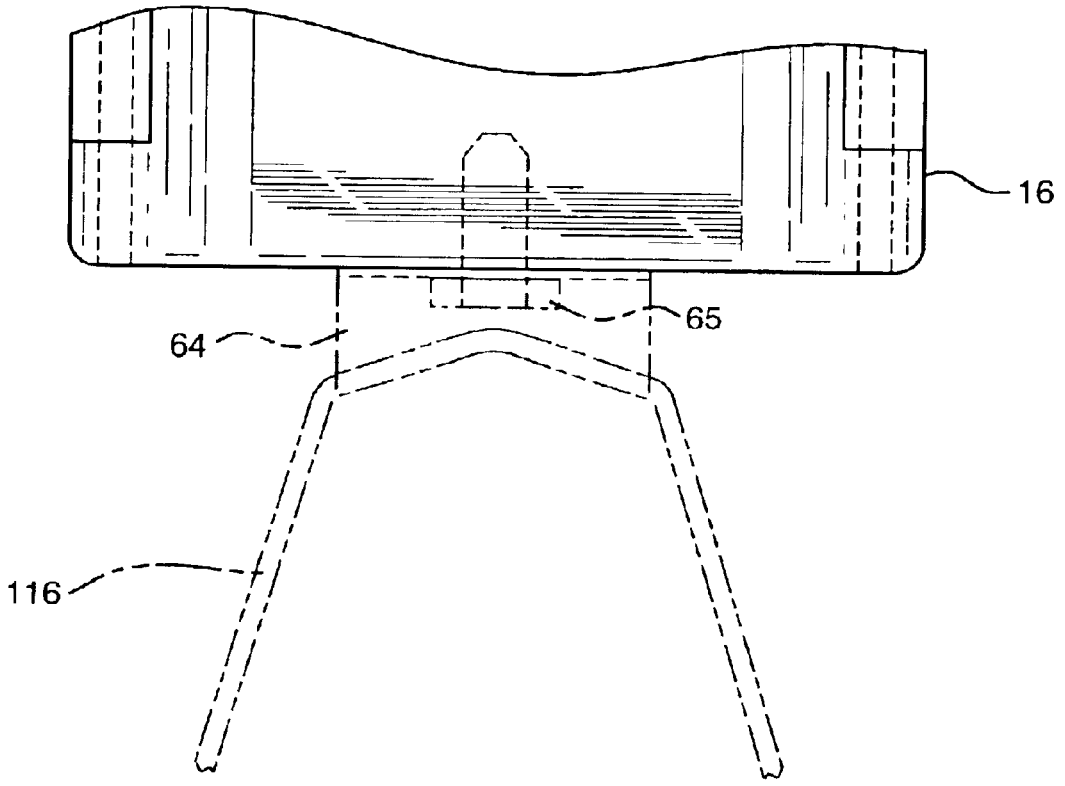
FIG. 19 is a front elevational view of the lower portion of the chain driver housing having a cable spreader bracket secured by a bolt under the housing.

Referring to FIG. 19, a front elevational view of the lower portion of the chain driver housing 16 is shown having a cable spreader mounting bracket attached with bolt 65. The cable mounting bracket keeps the cables 114, 116 in FIG. 18 clear of the chain 10.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A portable chain driver comprising:

a chain and rotor housing for receiving links of a chain;

a rotor assembly positioned within a cavity of said chain and rotor housing;

said rotor assembly comprises a chain pocket wheel and a chain sprocket wheel attached within said chain pocket wheel;

a rotor centering hub positioned through said front housing and into a center portion of said rotor assembly;

said rotor centering hub comprises a cam lever which is located within an opening in said housing;

a clutch disc having a first side positioned adjacent to said rotor assembly and a second side adjacent to a spring pack means for engaging and disengaging said clutch disc from said rotor assembly in response to the positioning of said cam lever; and a drive shaft inserted into said clutch disc and attaching within said rotor centering hub.

2. The portable chain driver as recited in claim 1 wherein said chain and rotor housing comprises means for securing a chain pail under said housing.

3. The portable chain driver as recited in claim 1 wherein said chain and rotor housing comprises a front housing and a rear housing, said front housing and said rear housing comprise means for securing said front housing and said rear housing together.

4. The portable chain driver as recited in claim 3 wherein said securing means comprises a first hinge pin on a first side of said housing and a second hinge pin on a second side of said housing wherein removal of one hinge pin allows said front housing to swing open for installing or removing said chain.

5. The portable chain driver as recited in claim 1 wherein said portable chain driver comprises means attached to said rotor assembly and extending through said front housing for controlling the operation of said rotor assembly.

6. The portable chain driver as recited in claim 5 wherein a power source is attached to said chain and rotor housing for driving said rotor assembly.

7. The portable chain driver as recited in claim 6 wherein said power source comprises an electrical power source.

8. The portable chain driver as recited in claim 6 wherein said power source comprises a gas driven power source.

9. The portable chain driver as recited in claim 6 wherein said power source comprises a handle.

10. The portable chain driver as recited in claim 9 wherein said handle comprises means for selecting the direction and speed of said chain passing through said housing.

11. The portable chain driver as recited in claim 1 wherein:

said chain and rotor housing comprises means for interfacing said rotor assembly to said power source.

12. The portable chain driver as recited in claim 11 wherein said rotor assembly comprises:

a rotor; and a bushing positioned around said rotor centering hub, said bushing pushes said clutch disc away from said rotor in response to lifting said clutch cam lever.

13. A portable chain driver comprising:

a chain and rotor housing for receiving links of a chain;

said chain and rotor housing comprises a rotor assembly enclosed within a front housing and a rear housing of said chain and rotor housing;

a power source attached to said chain and rotor housing for driving said chain through said housing;

means for interfacing said rotor assembly to said power source;

said rotor assembly comprises;

a rotor;

a rotor centering hub positioned through said front housing and into a center portion of said rotor;

a bushing positioned around said rotor centering hub;

a clutch disc having a first end positioned adjacent to said rotor;

said rotor centering hub comprises a clutch cam lever located within an end of said rotor centering hub for engaging and disengaging said clutch disc;

a drive shaft inserted into said clutch disc and attached within said rotor centering hub; and a spring pack positioned adjacent to a second end of said clutch disc, said drive shaft passing through said spring pack.

14. The portable chain driver as recited in claim 13 wherein said rotor centering hub comprises a lock screw for attaching said rotor centering hub to said drive shaft.

15. The portable chain driver as recited in claim 13 wherein said drive shaft comprises a hex portion for insertion into a hex receiving section of said clutch disc.

16. The chain and rotor housing as recited in claim 13 wherein:

said chain and rotor housing comprises a front housing section and a rear housing section; and said front housing section opens to install or remove said links of said chain.

17. A method of providing a portable chain drive comprising the steps of:

providing a chain and rotor housing having a chain sprocket wheel attached within a chain pocket wheel for receiving links of a chain;

providing a rotor assembly having a rotor and a rotor centering hub positioned into a center portion of said rotor;

positioning a cam lever located within an end of said rotor centering hub for engaging and disengaging a clutch disc;

positioning a bushing around said rotor centering hub and said clutch disc adjacent to said rotor;

inserting a drive shaft into said clutch disc, said drive shaft attaching within said rotor centering hub; and positioning a spring pack adjacent to an opposite side of said clutch disc wherein said drive shaft passes through said spring pack.

18. The method as recited in claim 17 wherein said step of providing said chain and rotor housing having a chain sprocket wheel attached within a chain pocket wheel comprises the step of providing said sprocket wheel in sections which are secured to said pocket wheel.

19. The method as recited in claim 17 wherein said method comprises the step of attaching a power source for driving a chain through said chain and rotor housing.

20. The method as recited in claim 19 wherein said step of attaching a power source comprises the step of attaching one of a gas driven power source, or an electrically driven power source.

21. The method as recited in claim 17 wherein said method comprises the step of attaching a pail under said chain and rotor housing for collecting said chain passing through said driver.

22. The portable chain driver as recited in claim 1 wherein said chain and rotor housing comprises two chain guides for guiding two separate chains of a circular orbital chain hoist.

23. The portable chain driver as recited in claim 1 wherein said chain and rotor housing comprises a chain installed in said housing around said rotor assembly whereby said chain enters and exits only at the top of said housing.

24. The portable chain driver as recited in claim 1 wherein said chain sprocket wheel within said chain pocket wheel captures each link of said chain and drives said chain.

25. The portable chain driver as recited in claim 1 wherein said rotor assembly comprises a bushing positioned around said rotor centering hub; and said cam lever moves said bushing towards or away from said clutch disk for engaging and disengaging said clutch disk with a rotor of said rotor assembly.

26. The method as recited in claim 17 wherein said step of providing said chain and rotor housing having a chain sprocket wheel attached within a chain pocket wheel comprises the step of capturing each link of said chain in said pocket wheel and driving said chain through said housing.

27. The method as recited in claim 17 wherein said method comprises the step of driving two separate chains of a circular orbital chain hoist through two chain guide sections of said housing.

28. The method as recited in claim 17 wherein said method comprises the step of placing a chain around said rotor whereby said chain enters and exits only at the top of said housing.

* * * * *